US005220303A

United States Patent [19]

Pannenborg et al.

[11] Patent Number: 5,220,303

[45] Date of Patent: Jun. 15, 1993

[54] MOLDED CASE CIRCUIT BREAKER LOW FRICTION LATCH ASSEMBLY

[75] Inventors: Erich J. Pannenborg; Joseph M. Palmieri, both of Southington, Conn.

[73] Assignee: General Electric Company, New York, N.Y.

[21] Appl. No.: 914,666

[22] Filed: Jul. 17, 1992

[51] Int. Cl.[5] ..... H01H 9/20

[52] U.S. Cl. ..... 335/167; 335/21; 335/172

[58] Field of Search ..... 335/21-24, 335/35-49, 167-176

[56] References Cited

U.S. PATENT DOCUMENTS 4,119,935 10/1978 Wien et al. ..... 335/167
4,513,268 4/1985 Seymour et al. ..... 335/35
4,698,903 10/1987 Ciarcia et al. ..... 29/622
4,789,848 12/1988 Castonguay et al. ..... 335/167

*Primary Examiner*—Lincoln Donovan
*Attorney, Agent, or Firm*—Richard A. Menelly

[57] ABSTRACT

A circuit breaker latch assembly eliminates the need for polishing the opposing latch surfaces to reduce static surface friction and lower the latching force. The end of the circuit breaker cradle operator is offset relative to the restraining surface of the armature-latch to reduce the static friction that must be overcome to move the armature-latch away from the cradle operator. Subsequent release of the cradle operator then allows the circuit breaker operating mechanism to separate the circuit breaker contacts upon the occurrence of predetermined overload current conditions.

7 Claims, 3 Drawing Sheets (PRIOR ART)

MOLDED CASE CIRCUIT BREAKER LOW FRICTION LATCH ASSEMBLY

BACKGROUND OF THE INVENTION

U.S. Pat. No. 4,513,268 entitled "Automated Q-Line Circuit Breaker" describes a fully automated residential-type circuit breaker assembly of the type employing a rotatable operating cradle having its end retained within an armature-latch slot to prevent the circuit breaker operating mechanism from separating the circuit breaker contacts. The latching of the operating cradle within the armature-latch slot is considered a "primary" latch.

U.S. Pat. No. 4,789,848 entitled "Molded Case Circuit Breaker Latch and Operating Mechanism Assembly" describes a latching assembly that includes a primary and a secondary latch. The primary latch is comprised of the operating cradle assembly wherein the secondary latch prevents the cradle from releasing until the secondary latch is first released.

As described within U.S. Pat. No. 4,698,903 entitled "Circuit Breaker High Speed Assembly", a drawback to efficient high speed circuit breaker manufacture is the time-consuming polishing process required on the primary and secondary latching surfaces. The polishing is required to minimize the amount of tripping force that must be applied to overcome the bias of the operating spring and the static friction of the latch surfaces. Although the polishing can be done in a separate pre-assembly process without effecting the actual circuit breaker assembly operation, the trip force required to overcome the operating spring bias and the latch surface friction depends to a certain extent upon the polishing operation. The primary and secondary latch surfaces are fabricated from stamped metal parts which exhibit a rough burr on the edge of one surface and a smooth die roll on the edge of the opposite surface. With secondary latch mating surfaces, the burr edge surface can result in variable frictional forces even after polishing.

An early attempt to reduce friction between the secondary latching surfaces is described within U.S. Pat. No. 4,119,935 entitled "Circuit Interrupter Including Low Friction Latch". This Patent describes latch surfaces having a rough and smooth portion resulting from the metal stamping operation and disposes the secondary latch surface so that only the smooth portion of the latch surfaces are in contact.

U.S. Pat. No. 4,698,903 improves over the earlier described secondary latch assembly within U.S. Pat. No. 4,119,935 by orienting the secondary latch surfaces so that the smooth die roll edges are in contact and further reduces the friction between the primary latch surfaces by a shaving operation applied to the end of the cradle to further reduce the friction encountered between the end of the cradle and the latch surface. The shaving operation is described within the publication entitled "Advanced Die Making", McGraw Hill Book Company, 1967 edition, New York, New York.

In an attempt to reduce the primary latch friction, without requiring either polishing or shaving during the circuit breaker assembly operation, a highly polished shim insert was positioned within the armature-latch arrangement in an off-line assembly described in the aforementioned U.S. Pat. No. 4,513,268. The insert was in the form of a highly polished stainless steel shim that was welded or brazed within the cradle retaining slot formed in the armature-latch component. It would be economically advantageous to eliminate the on-line shaving process and to eliminate the off-line polished shim insert without effecting the circuit breaker trip response.

It is accordingly one purpose of the invention to substantially reduce the static friction existing between the primary latch surfaces without requiring any shaving or shim insertion operations whatsoever.

SUMMARY OF THE INVENTION

A circuit breaker primary latch arrangement of the type engaging the end of an operating cradle in a latching slot formed within an armature-latch component is provided with a low friction interface between the end of the cradle and the surface of the armature-latch slot. The surface of the armature-latch slot is oriented to present a smooth latching surface to the cradle end while the cradle end is offset at a predetermined angle to present minimum contact with the latching surface, thereby substantially reducing the static friction and lowering the trip force requirement.

DESCRIPTION OF THE PREFERRED EMBODIMENTS

Figure 1:
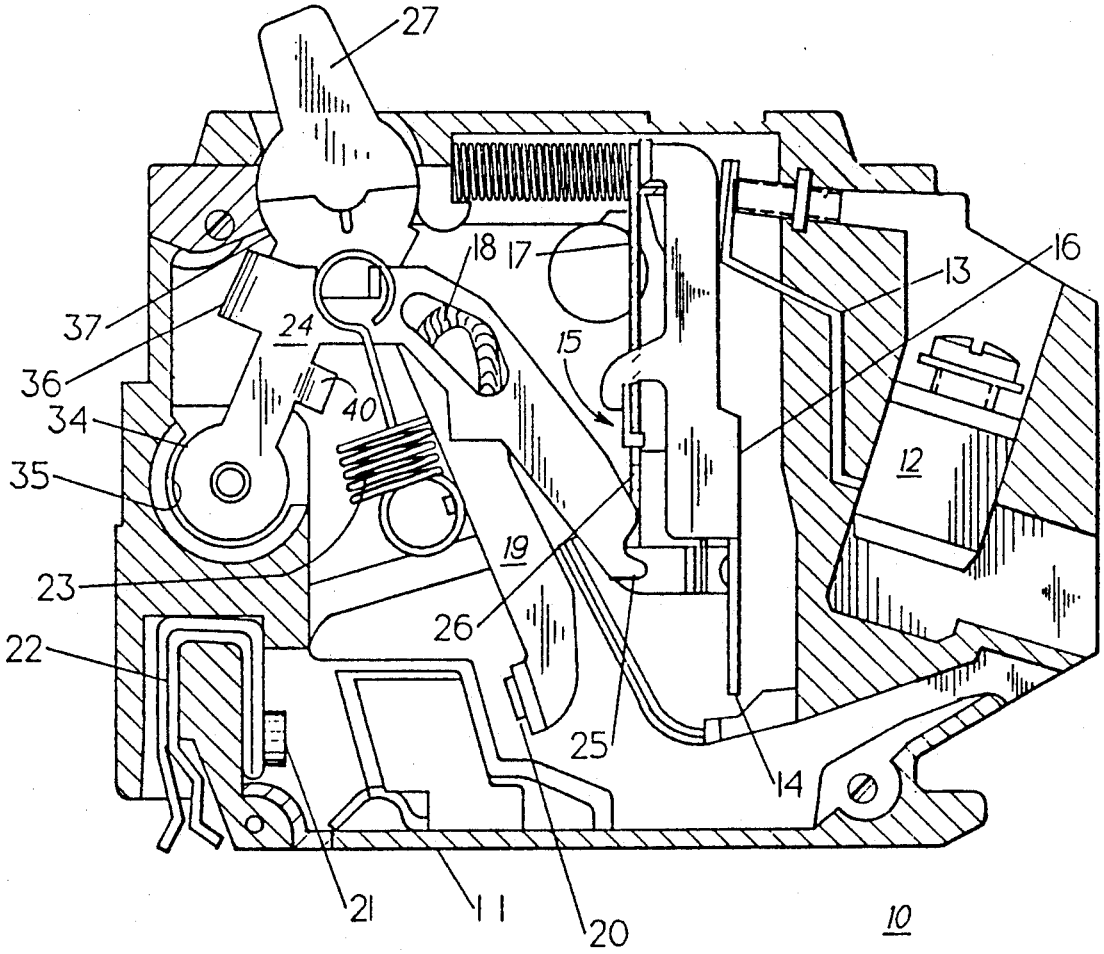
FIG. 1 is a side view of a residential circuit breaker with the cover removed to depict the operating components.

A residential type circuit breaker 10, such as described within the aforementioned U.S. Pat. No. 4,513,268, is shown in FIG. 1 and consists of a molded plastic case 11 with the load terminal lug 12 arranged at one end. The current path proceeds from the load terminal lug through the load strap 13, bimetal 14, braid conductor 18 to the movable contact arm 19 that supports the movable contact 20 at one end. The electrical path is completed through the fixed contact 21, which engages an electric external circuit by means of the line terminal stab 22. The circuit current transfers between the fixed and movable contacts until an overcurrent condition is sensed by means of the bimetal 14 or the magnetic trip unit 15. The magnetic trip unit includes a magnet 16 which interacts with a pivotally arranged armature-latch 17. With the circuit breaker contacts in their closed position, the operating spring 23 which is attached to the movable contact arm 19 is positioned over-center by manual operation of the ON-OFF handle 27. The cradle end 25 sits within and is retained by the latching slot 26 formed within the armature-latch 17. Upon the occurrence of a so-called "short time" overcurrent condition of predetermined duration, the magnetic trip unit responds by drawing the armature-latch towards the magnet 16, thereby displacing the latching slot 26 out from under the cradle end 25, allowing the cradle 24 to rotate in the clockwise direction and allow the operating spring 23 to rapidly pull the movable contact arm 19 and the accompanying movable contact 20 away from the stationary contact 21 to interrupt the circuit current. The bimetal 14 responds in a similar manner under so-called "long time" overcurrent conditions.

Figure 2:
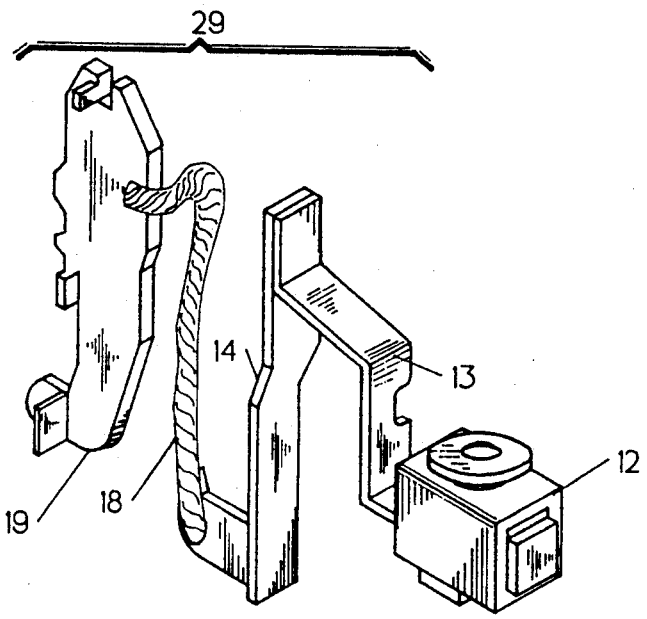
FIG. 2 is a top perspective view of the primary current path components within the circuit breaker of FIG. 1.

The current path assembly 29, depicted in FIG. 2, includes the load terminal lug 12, load strap 13 and the bimetal 14 which is welded or brazed to the top part of the load strap. The braid conductor 18 is welded or brazed to the bottom extension of the bimetal at one end and is welded or brazed to the movable contact arm 19 at the other end to complete the current path assembly.

Figure 3:
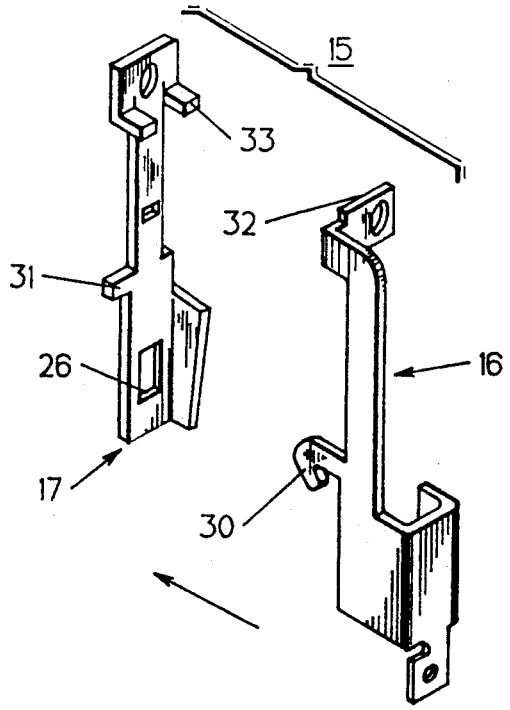
FIG. 3 is a top perspective view of the magnetic trip unit within the circuit breaker of FIG. 1 prior to assembly.

The magnetic trip unit 15 is shown in FIG. 3 prior to pivotally arranging the tab 32 extending from the top of the magnet 16 over the pair of tabs 33 on the top part of the armature-latch 17 and hooking the hook 30 extending from the magnet over the extension 31 on the side of the armature-latch 17. The latching slot 26 is formed in the bottom of the armature-latch to retain the cradle end in the manner described earlier.

Figure 4:
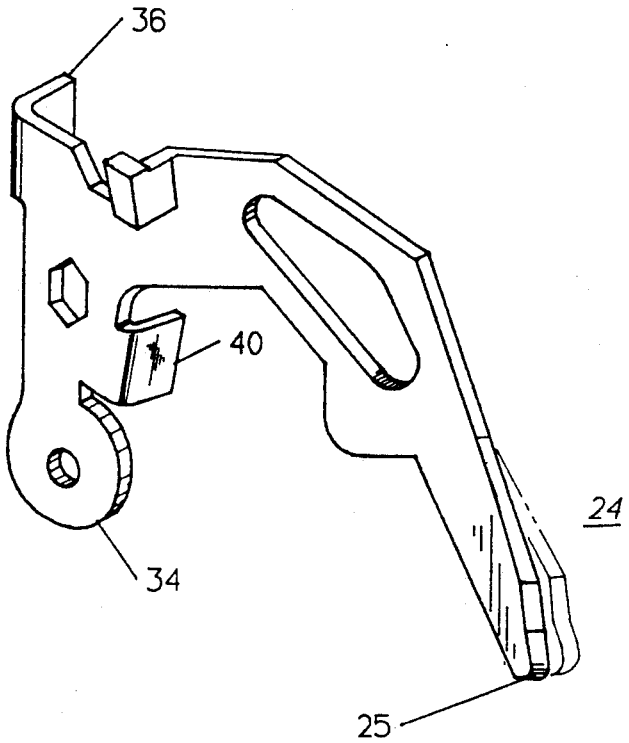
FIG. 4 is an enlarged top perspective view of the cradle operator within the circuit breaker of FIG. 1.

In accordance with the invention, the operating cradle 24 has the configuration depicted in FIG. 4 wherein the cradle is formed from a single U-shaped body configuration formed to a radial bottom part 34 which is rotatingly received in the appropriate hemispherical recess 35 formed within the case 11, shown in FIG. 1, for allowing the cradle to rotate between its latched and unlatched conditions. The offset tab 36 at one end of the top part of the cradle interacts with one part of the shoulder 37 integrally formed with the ON-OFF handle 27, shown earlier in FIG. 1. The opposite tab 40 extending parallel with tab 36 picks up an opposite part of the shoulder when the ON-OFF handle 27 is moved between its ON and OFF positions.

Figure 5:
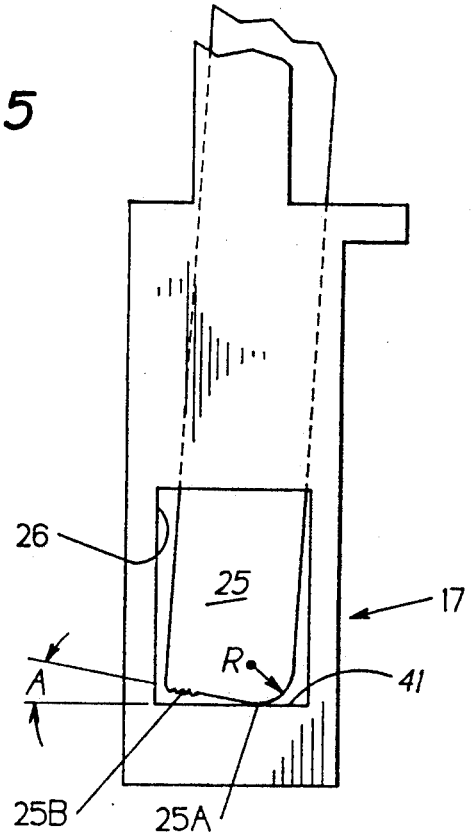
FIG. 5 is an enlarged top perspective view of a part of the armature-latch and operating cradle within the circuit breaker of FIG. 1.

The cradle end 25 is offset from the vertical plane, as viewed in FIG. 4 and indicated in phantom, to present a predetermined point of contact 25A, as best seen by referring collectively to FIGS. 4 and 5. The rectangular latch 17 is depicted with the latch surface 41 arranged in the horizontal plane, as viewed in FIG. 5, within the latching slot 26. The cradle end 25 is positioned within the latching slot at a predetermined angle of contact A, such that the smooth part 25A abuts the latching surface 41 and the rough part 25B is out of contact with the latching surface. It has been determined that the angle of contact effects the static and dynamic friction generated between the cradle end and the latching surface. Since both the static and dynamic friction determine the latching forces generated by the over-centered operating spring 23, described earlier with reference to FIG. 1, the contact angle A is set to minimize both the static and dynamic friction effects. Too large an angle could result in contact with the large area defined by the radius of curvature R created at one edge of the cradle end by the stamping process described earlier to increase both the static and dynamic friction, whereas too small an angle could result in contact with the large planar surface on the cradle end to increase the static and dynamic friction generated therebetween. An angle of contact between the cradle end and the latching surface ranging from 5 degrees to 25 degrees produces beneficial reductions in both static and dynamic friction forces with a corresponding reduction in the tripping force required to remove the latching slot from under the cradle end.

There has herein been described an economical arrangement for reducing the trip forces required to overcome the primary latch forces developed between the end of an operating cradle and the cradle latching surface within circuit breaker interrupter operating mechanisms. The angle generated between the edge of the cradle and the latching surface must be carefully controlled to optimize the low tripping force enhancement.

Having thus described our invention, what we claim and desire to secure by Letters Patent is:

1. A molded case circuit breaker having a low friction latch assembly comprising:

a molded plastic case attached to a molded plastic cover;

an operating mechanism arranged within said case for interrupting current through a protected circuit upon the occurrence of an overcurrent conditions;

a pivotally-mounted operating cradle interacting with said operating mechanism by means of a shaped end, said shaped end defining a rough edge and a smooth edge;

a magnetically-responsive armature latch having an opening receiving said shaped end and retaining said operating mechanism from interrupting said current under quiescent current conditions; and a planar latching surface on a bottom periphery of said opening, said bottom periphery being arranged parallel to a first plane, said shaped end being offset on said latching surface at a predetermined angle relative to said first plane to lift said rough edge off said latching surface and thereby provide a predetermined latching force to said operating mechanism.

2. The circuit breaker of claim 1 wherein said shaped end is formed from a metal-forming operation.

3. The circuit breaker of claim 1 wherein said angle ranges between 5 and 25 degrees relative to said first plane.

4. The circuit breaker of claim 3 wherein said opening defines a rectangular configuration.

5. An operating mechanism for molded case circuit breakers comprising in combination:

a releasable operating cradle pivotally supported at one end and defining a shaped hook at an opposite end;

a magnetically-responsive armature latch adjacent said cradle and including a rectangular slot defining a latching surface on a periphery thereof parallel to a first plane;

a charged operating spring holding said cradle hook on said latching surface thereby providing a latching force to said cradle; and a rough edge and a smooth edge formed on said cradle hook, said smooth edge contacting said latching surface and said rough edge being out of contact with said latching surface for reducing said latching force to a minimum value.

6. The operating mechanism of claim 5 wherein said cradle hook contacts said latching surface at a predetermined angle relative to said first plane.

7. The operating mechanism of claim 6 wherein said angle comprises between 5 and 25 degrees.

* * * * *